United States Patent [19]

Oetiker

[11] Patent Number: 4,685,159

[45] Date of Patent: Aug. 11, 1987

[54] HOSPITAL BED

[76] Inventor: Hans Oetiker, Oberdorfstrasse 21, CH-8810 Horgen 2, Switzerland

[21] Appl. No.: 732,269

[22] Filed: May 9, 1985

[51] Int. Cl.[4] ..... A61G 7/00

[52] U.S. Cl. ..... 5/61; 5/60; 5/62; 5/63; 5/68; 5/90

[58] Field of Search ..... 5/60, 61, 66, 67, 68, 5/69, 62, 63, 65, 90

[56] References Cited

U.S. PATENT DOCUMENTS

| | | | |
|---|---|---|---|
| 3,724,004 | 4/1973 | Behrens | 5/66 |
| 3,739,406 | 6/1973 | Koetter | 5/68 |
| 3,818,516 | 6/1974 | Hopper et al. | 5/63 |

*Primary Examiner*—Alexander Grosz
*Attorney, Agent, or Firm*—Craig & Burns

[57] ABSTRACT

A hospital bed which includes a bed frame consisting of a center bed frame section and of a head bed frame section and foot bed frame section pivotal relative to the center bed frame section; the bed frame is supported relative to a chassis by way of a first intermediate yoke-like frame structure providing pivotal movement in either direction of the bed frame about a single transverse axis; the first intermediate frame structure is pivotally connected with a second intermediate frame structure to provide tilting about a longitudinal axis; the second intermediate frame structure which consists of a parallelogram-linkage system provides for height adjustments of the bed frame and is so constructed and arranged as to permit the bed frame to assume a nearly vertical position with the foot bed frame section at the bottom without interference from the transverse bearer member of the chassis.

17 Claims, 8 Drawing Figures

FIG. 5
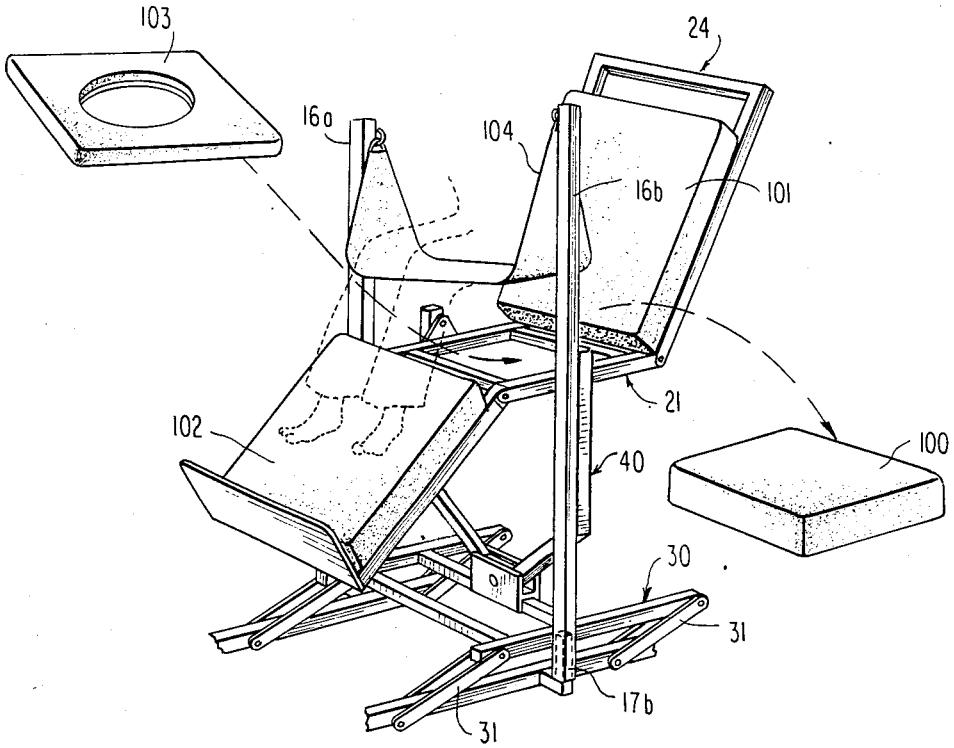
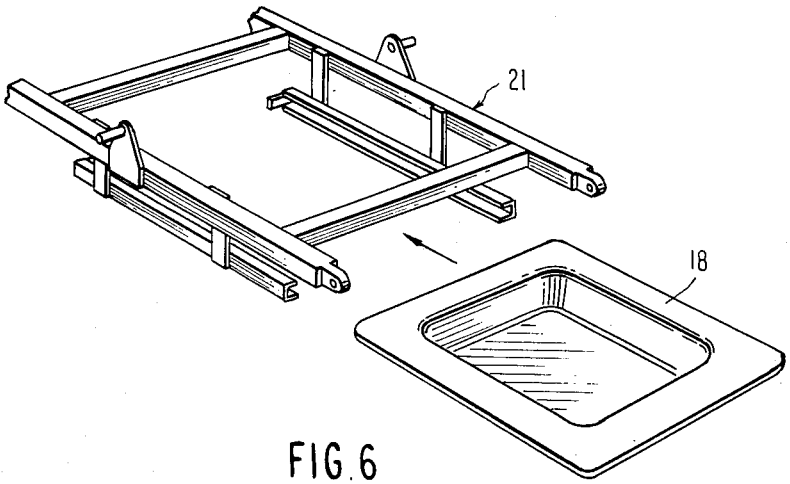
FIG. 6

HOSPITAL BED

The present invention relates to a hospital bed which offers a number of features to assure great versatility in its use.

Hospital beds which can be raised and lowered, tilted about a longitudinal axis, and adjusted into various position of its bed are known in the prior art. For example, the U.S. Pat. No. 3,739,406 to Koetter discloses a hospital bed in which a bed frame is tiltable relative to the chassis, can be raised and lowered by telescopically extendable members at both ends thereof and includes two end portions hinged to the middle portion of the bed frame. However, this patent utilizes two independently actuated telescopically extendable actuators to raise and lower the head portion and leg portion of the bed. As a result thereof, it is relatively complex in its actuating mechanisms and limited in the various positions into which it can be adjusted. The U.S. Pat. No. 3,724,004 to Behrens discloses a hospital bed similar to that of the aforementioned patent in that it requires separate head end and leg end actuators. Furthermore, this patent involves complicated structures such as the differential unit and additionally subjects the actuator unit to bear a major load. The present invention differs from both of these patents in that the hospital bed can be raised and lowered by the use of a parallelogram-linkage system to which an intermediate frame having a yoke-like construction is pivotally connected about a longitudinal axis, whereby the yoke-like intermediate frame carries the bed frame pivotal about a single transverse axis. The use of lifting arms, as such, is disclosed in the U.S. Pat. No. 3,818,516 to Hopper et al. Apart from other limitations in the adjustability of the hospital bed disclosed in this patent, its lifting arms are individually actuated and do not constitute a parallelogram-linkage system as disclosed by the present invention. The U.S. Pat. No. 3,200,416 to Warrick discloses a hospital bed in which the bed is pivotal about a single transverse axis with the bed additionally tiltable about a longitudinal axis. However, this patent provides no height adjustment, requires a spring to counter-balance the weight of the patient and involves a relatively complicated crank drive mechanism. Furthermore, this patent requires a separate plate structure for the knee position and is limited to a maximum head-down position of 15° which is considered totally inadequate at present in case of unconscious patients.

The present invention is characterized by a combination of features, some or many of which may be individually known as such in the prior art, to provide a hospital bed which can be readily adapted to the condition of the patient, is relatively simple in structure and permits the patient to get on and off the hospital bed by merely stepping on and off the same when the hospital bed is in a nearly vertical position. Additionally, all positions of the hospital bed can be readily adjusted by the patient with the control of appropriate push buttons or the like. With the use of electric motors in the actuator units for the various positional adjustments, it becomes possible to utilize presently available control technology to provide certain safety features. Additionally, the hospital bed in accordance with the present invention offers a conversion possibility to utilize the same as a toilet in case the injury or sickness of the patient does not permit physical movement to a bathroom. Various proposals have been made in the prior art to achieve the same goal. For example, the U.S. Pat. No. 3,345,652 to Hiraga discloses a clinical commode in which the hip-supporting platform is movable from a closed position to an open position in which it leaves an opening through the frame while a commode is located beneath the hip-supporting platform. In contrast thereto, the present invention utilizes the height-adjusting feature of the hospital bed to hold the patient in the maximum raised position to permit exchange of a toilet set for the corresponding mattress part in the center section of the bed while the mattress is lowered. With the head portion of the hospital bed and the foot portion thereof adjusted into a seat-like position and with the hospital bed raised again after the toilet seat is installed, the patient can be seated in a comfortable position while utilizing the hospital bed as an emergency toilet.

The hospital bed in accordance with the present invention is characterized by the combination of a number of features co-acting to provide the advantages of a novel hospital bed. The bed frame which is subdivided into a head bed frame section, a center bed frame section and a foot bed frame section pivotally connected to one another is supported relative to a chassis frame by way of a first intermediate frame structure of yoke-like configuration which is pivotally connected in its upper area to the center section of the bed frame about a single transverse axis and which is pivotally connected about a longitudinal axis to a second intermediate frame structure that provides raising and lifting of the first intermediate frame structure and therewith of the bed frame. Five individually operable actuator units are provided to adjust the head bed frame section relative to the center bed frame section about a first transverse axis, to adjust the foot bed frame section relative to the center bed frame section about a second transverse axis, to rotate the bed frame about a third transverse axis located in the center area of the center bed frame section about a third transverse axis, to tilt the first intermediate frame structure and therewith the bed frame about the longitudinal axis and to raise and lower the first intermediate frame structure and therewith the bed frame structure relative to the chassis by the second intermediate frame structure. The second intermediate frame structure which, in a preferred realization is in the shape of a parallelogram-linkage system, is so arranged and constructed as to permit the bed frame structure to be rotated about the third transverse axis into an at least nearly vertical position without interference by the chassis cross bearer so as to permit the patient to get on and off the hospital bed in an ambulatory manner. Additionally, the use of electric motors permits a control system which normally leaves the control of the five actuator units under the control of the patient. However, the control system, utilizing conventional electrical and/or electronic control techniques, also permits selective disablement of one or the other control features as well as an interlock system precluding adjustment of the hospital bed into certain positions unless started from a predetermined position.

These and other objects, features and advantages of the present invention will become more apparent from the following description when taken in connection with the accompanying drawing, which show, for purposes of illustration only, one embodiment in accordance with the present invention, and wherein:

FIG. 5 is a perspective view of the hospital bed in accordance with the present invention illustrating the modification of the bed to convert it into an emergency toilet;

FIG. 6 is a partial perspective view illustrating the installation of a basin when used as emergency toilet;

Figure 1:
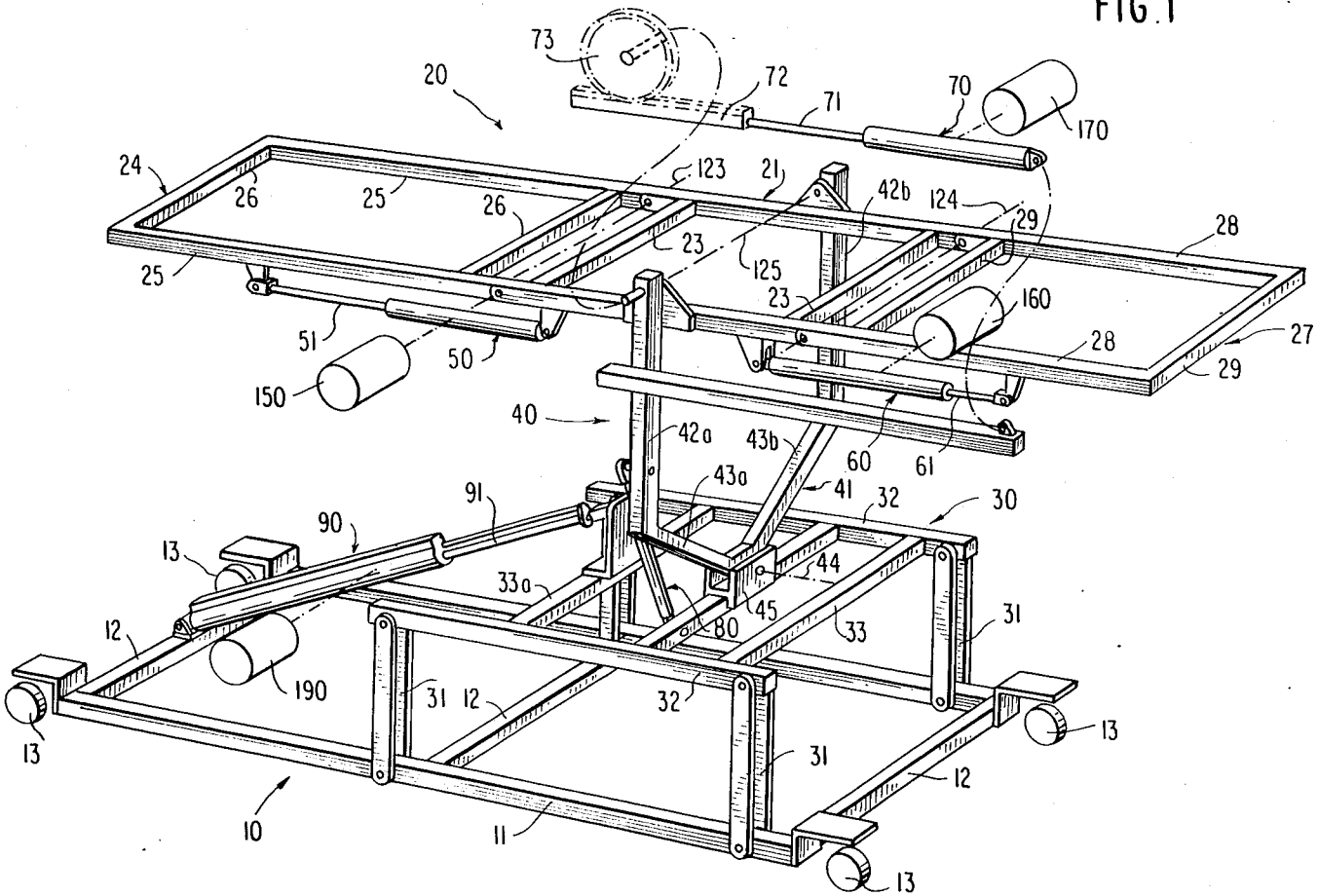
FIG. 1 is a schematic perspective view of the hospital bed in accordance with the present invention.
Figure 2:
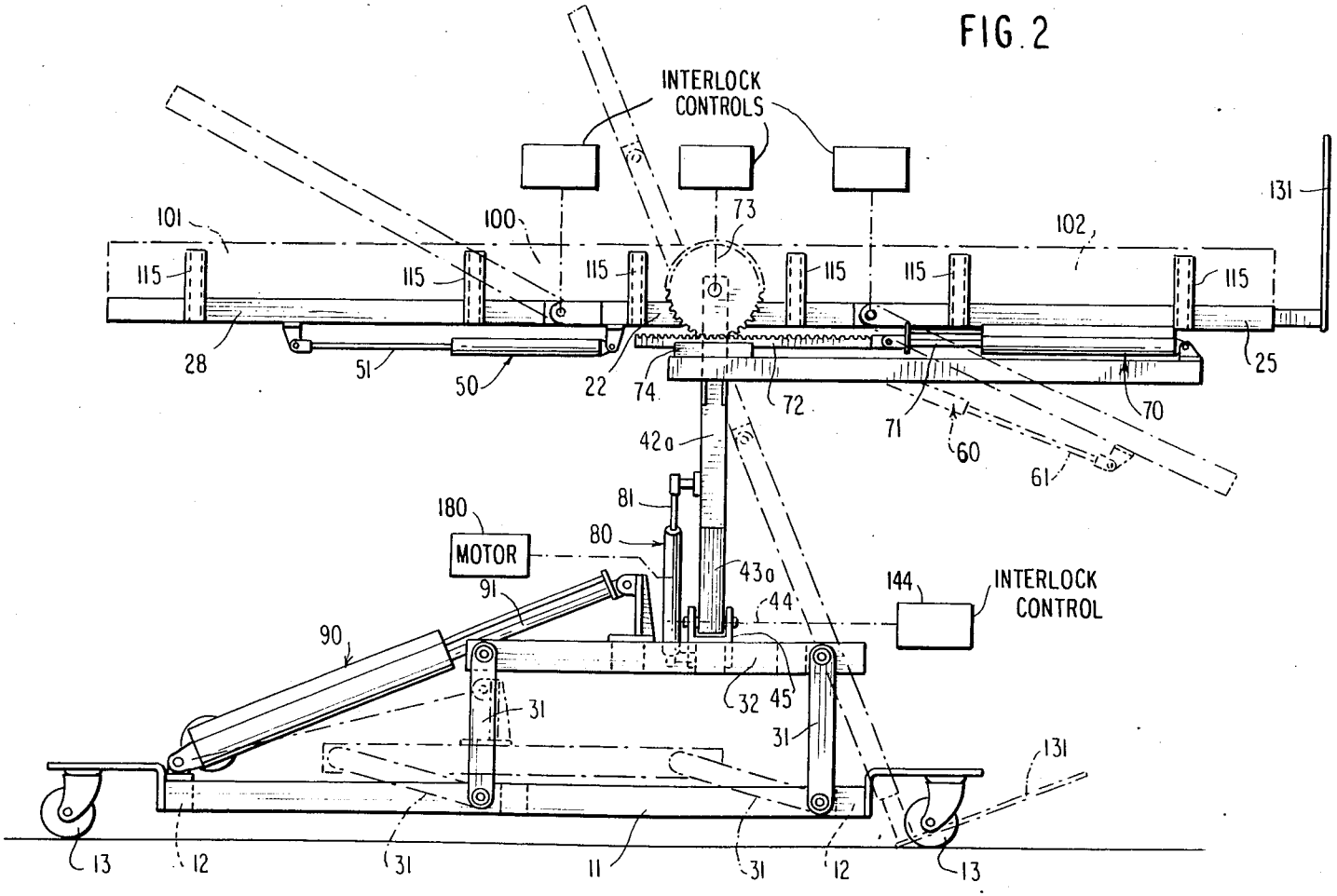
FIG. 2 is a somewhat schematic side elevational view of the hospital bed in accordance with the present invention.
Figure 3:
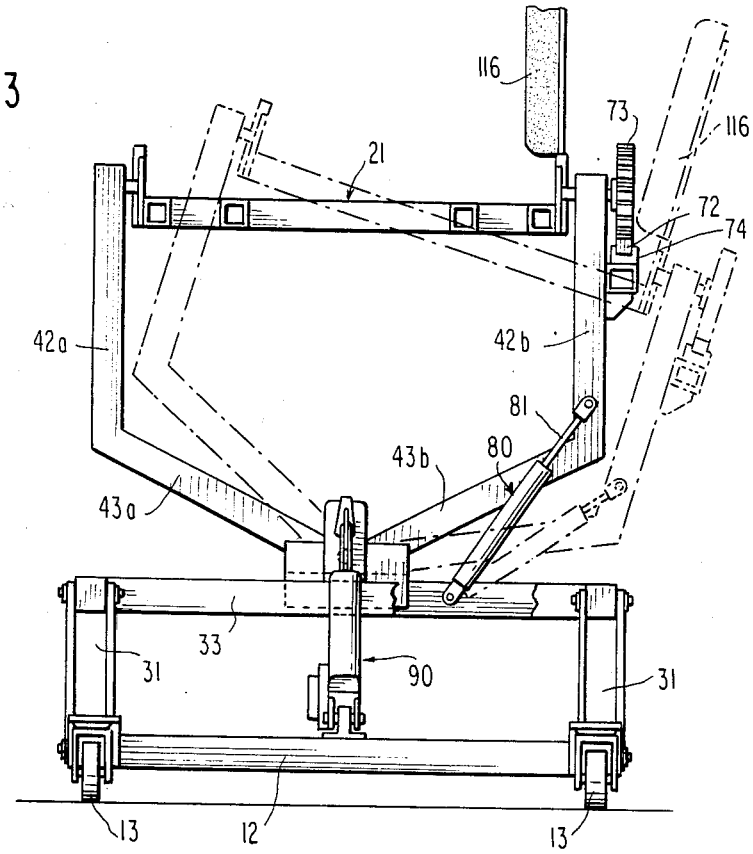
FIG. 3 is an end elevational view of the hospital bed of FIG. 2.

Referring now to the drawing wherein like reference numerals are used throughout the various views to designate like parts, and more particularly to FIGS. 1-3, reference numeral 10 generally designates a chassis consisting of longitudinal bearer members 11 and transverse bearer members 12, rigidly interconnected with one another. Casters 13 are supported on the chassis frame 10 in the four corner areas thereof. The casters 13 may be of any conventional construction and may be provided with individual locking devices or a centrally operated locking device. In the alternative, at least some of the casters may be replaced by wheels, as known in the art.

Figure 4:
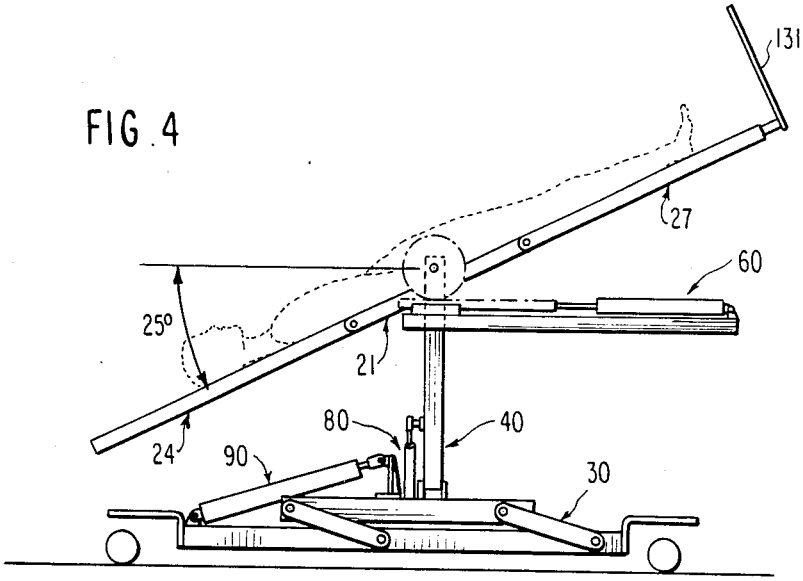
FIG. 4 is a side view of the hospital bed in accordance with the present invention in the heads-down position.

The three-partite bed frame generally designated by reference numeral 20 consists of a center bed frame section generally designated by reference numeral 21, of a head bed frame section generally designated by reference numeral 24 and of a foot bed frame section generally designated by reference numeral 27. The center bed frame section 21 includes longitudinal frame members 22 and cross frame members 23. The head bed frame section 24 includes longitudinal frame members 25 interconnected by cross frame members 26. The longitudinal frame members 25 are pivotally connected in any conventional manner to the longitudinal frame members 22 of the center bed frame section 21 so as to provide a first transverse pivot axis 123. The foot bed frame section 27 which consists of longitudinal frame members 28 interconnected by cross frame members 29 is pivotally connected with its longitudinal frame members 28 at the longitudinal frame members 22 in a manner similar to the head bed frame section so as to provide a second transverse pivot axis 124. Of course, the respective bed frame sections may be additionally reinforced in any conventional manner. The bed frame 20 is supported relative to the chassis frame 10 by way of a first intermediate frame structure generally designated by reference numeral 40 and by way of a second intermediate frame structure generally designated by reference numeral 30. The second intermediate frame structure 30 which at the same time serves for raising and lowering the bed frame structure consists of a parallelogram-linkage system including lifting frame members 31 pivotally connected near their lower ends to the longitudinal chassis bearers 11 and pivotally connected near the upper ends to the longitudinal frame members 32 and cross frame members 33. In the lowermost position of the hospital bed, the lifting frame members 31 are rotated counterclockwise, as viewed in FIG. 1, into a position substantially parallel to the longitudinal bearer members 11 of the chassis 10. The first intermediate frame structure 40 is of yoke-like configuration (FIG. 3) and consists of an approximately U-shaped bearer member generally designated by reference numeral 41 that includes upright frame portions **42*a* and 42*b* and inwardly, slightly downwardly extending frame portions 43*a* and 43*b*. At the point of intersection of the frame portions 43*a* and 43*b*, the first intermediate frame structure 40 is pivotally connected by any conventional means to a reinforcing transverse frame member 33*a* of the second intermediate frame structure 30 about a longitudinal axis 44 (FIG. 2). For example, a bracket member 45 fixed to the cross frame member 33*a* accommodates the necessary bearing parts to provide pivotal movement of the first intermediate frame structure 40 relative to the second intermediate frame structure 30 about the longitudinal axis 44. A first actuating mechanism generally designated by reference numeral 50 which includes an extensible member 51 and is pivotally connected between the longitudinal frame member 22 and 25 permits raising and lowering of the head bead frame section 24 relative to the center bed frame section 21. A second actuating mechanism generally designated by reference numeral 60 which includes an extensible member 61 is pivotally interconnected between the center bed frame section 21 and the foot bed frame section 27 to permit lowering and raising of the foot bed frame section 27 relative to the center bed frame section 21. A third actuating mechanism generally designated by reference numeral 70 includes an extensible member 71 carrying at the free end thereof a rack 72, which is adapted to engage with a gear 73 mounted fixedly on the center bed frame section 21 so as to rotate the latter about the transverse axis 125 in either direction of rotation as the rack is being displaced toward the left or the right. The end of the actuating mechanism 70 opposite the rack 72 is pivotally connected with the first intermediate frame structure 40. The extensible member 71 and the rack 72 are thereby securely guided, for example, in a channel member 74 (FIG. 3), rigidly connected with the first intermediate frame structure 40. This particular arrangement permits by selection of a suitable length of the rack 72 to rotate the bed frame structure 20 counterclockwise—as viewed in FIG. 1—into a heads-down position exceeding 25° with respect to the horizontal position (FIG. 4), as required in case a patient is unconscious and to rotate the bed frame structure 20 clockwise into a nearly vertical feet-down position as shown in FIG. 2 in dash lines in which the foot board 131 engages the floor. A headboard (not shown) similar to the foot board 131 may also be installed as a safety measure when adjusting the bed into the position of FIG. 4**.

A fourth actuating mechanism generally designated by reference numeral 80 (FIG. 2) which includes an extensible member 81 is pivotally connected between the center corss frame member **33*a* of the second intermediate frame structure 30 and the upright frame portion 42*a* of the yoke-like first intermediate frame structure 40 so as to enable tilting of the first intermediate frame structure 40 and therewith the bed frame 20 about the longitudinal axis 44** in either direction of rotation.

Finally, a fifth actuating mechanism generally designated by reference numeral 90 which also includes an extensible member 91, is pivotally connected between the left chassis bearer member 12, as viewed in FIG. 1, and the cross frame member 33*a* of the second intermediate frame structure 30 to change the height of the hospital bed as its extensible member 91 is extended and retracted, thereby causing pivoting of the lifting frame members from their near horizontal position (lowest hospitable bed height) to their near vertical position (maximum hospital bed height) and vice versa, respectively.

The five actuating units 50, 60, 70, 80 and 90 are preferably commercially available units utilizing electric motors 150, 160, 170, 180 and 190 (FIGS. 1 and 2) to extend and retract the respective extensible member by rotating the motor in one or the other direction of rotation. The driving connection between the motor and the extensible member is thereby preferably made in such a manner by conventional means as to provide a self-locking action to preclude movement when the motor is de-energized. A control unit (not shown) interconnects a push-button control panel (FIG. 8) normally under control of the patient with the respective electric motors of the actuating units so as to permit separate and individual adjustment of each actuating unit. Appropriately, the control unit which is located out of reach of the patient, for instance, on chassis 10, includes disabling means in the form of switches or the like of any conventional type to prevent use of any one or more of the actuating units by the patient, depending on the patient's condition. Additionally, appropriate interlocking means of any conventional type may be provided on the hospital bed which prevent energization of a given electric motor when the hospital bed is not in a predetermined position. For example, energization of the electric motor 180 for the fourth actuating unit 80 is to be prevented by the interlocking device 144 (FIG. 2) unless the bed frame structure 20 is in a horizontal position. Similarly, energization of the fifth actuating unit 90 may be precluded unless the bed frame structure is in a non-tilted position, i.e., the fourth actuating mechanism 80 is in the normal center position in which the center bed frame section 20 is also in a non-tilted position. By the use of conventional control techniques, it may also be possible to automatically adjust at first the respective part of the hospital bed to a predetermined position before proceeding with energization of the electric motor which was intended to be energized by depressing the corresponding control button. For example, when depressing the control button to energize the electric motor of the fourth actuating unit 80, the first, second and third actuating units 50, 60 and 70 may be automatically energized to return the various bed frame sections into their horizontal positions before the motor of the fourth actuating unit is then energized. This type of control technique can also be applied in any desired manner to the other actuating units. Since these control techniques utilizing known electrical (switch and relay) devices and/or electronic control components are known in the art, a detailed description thereof is dispensed with herein for the same of simplicity.

To prevent interference by the right transverse bearer member 12 of the chassis frame 10, as viewed in FIG. 1, with the foot bed frame section 27 when the bed frame 20 is in the nearly vertical position and the foot rest 131 is on the floor, as shown in dash lines in FIG. 2 to permit the patient to get on and off the hospital bed in an ambulatory manner, the parallelogram-linkage system 31, 32, 33 of the second intermediate frame structure 30 is moved closer to the right (foot) end of the chassis frame 10. Additionally, the third transverse axis 125 about which the bed frame 20 will rotate, is moved toward the right (foot) end of the chassis 10, and the lifting frame members 31 in conjunction with the fifth actuating mechanisms 90 are so arranged that they rotate from a nearly horizontal position corresponding to the minimum height position of the hospital bed into their vertical position in the direction toward the foot end of the chassis 10 to raise the hospital bed into the maximum height position. This causes the third pivot axis 125 to be moved sufficiently toward the foot end of the chassis frame 10 that the bed frame 20 can be rotated in the clockwise direction, as viewed in FIG. 1, until it reaches the nearly vertical position without interference by the right transverse bearer member 12.

Mattress sections 100, 101 and 102 are supported, on the center frame bed section 20, head frame bed section 24 and foot frame bed section 27, respectively. To provide emergency toilet facilities, for example, for a patient unable to walk, the center mattress section 100 or a part thereof is adapted to be interchanged for a toilet seat 103 (FIG. 5). To permit such interchange, the hospital bed is first raised to its maximum height, lateral support columns 16*a* and 16*b* are installed in appropriate mounting supports provided on both sides of the chassis frame 10 and of which mounting support 17*b* is shown in FIG. 5 with a similar mounting support provided symmetrically on the other side of the chassis frame 10. A hammock-like web 104 is then slipped underneath the patient seated on the center mattress section 100 and the ends thereof are thereafter hooked into appropriate fastening means on the support columns 16*a* and 16*b*. Thereafter, the hospital bed is lowered so that the patient is held in the pre-existing position, seated on the hammock-like web 104. The mattress portion 100 is then exchanged for the toilet seat 103, a basin 18 or the like is installed underneath the toilet seat (FIG. 6), and the hospital bed is raised again until the patient comes to be supported on the toilet seat 103, whereupon the hammock-like web 104 is removed. In lieu of the hammock-like web 104, the support columns 16*a* and 16*b* may be provided with blade-like support members (not shown) fixedly secured thereto which extend toward one another and are sufficiently rigid yet sufficiently thin so that they can be inserted between the mattress 100 and the seated patient to perform the same function as the hammock-like web 104. Moreover, a wedge-shaped member (not shown) may be used to convert the bed as toilet. The bed is thereby tilted to one side so that the patient will come to lie on the lower side. The wedge-shaped member which is constructed of greater length than the center mattress section 100 but of a smaller width and which is cut-out in its center, is then placed with its end portions over the mattress sections 101 and 102; the bed is tilted in the opposite direction so that the patient comes to rest on the non-recessed end portions of the wedge-shaped member, whereupon the mattress center section 100 can be removed and replaced by the toilet seat 103. To weigh the patient, a shell-like member having the length of the bed can be used in a similar manner by securing it to the mounting supports of which only mounting support 17*b* is shown in FIG. 5 and thereafter lowering the bed, thereby leaving the patient in the shell-like member. In addition to using the shell-like member for weighing purposes, a similar procedure can also be used to rotate the patient through 180°, e.g. from his back on his stomach. The shell-like member consists of a flat bottom part and of a flat top part hingedly connected along the sides so that the shell-like member can be conveniently pulled out from under the patient when no longer needed.

FIG. 3 illustrates a bed guard rail 116 to protect the patient from falling off the bed when the bed is tilted. A similar guard rail may, of course, be provided also on the opposite side.

Figure 7:
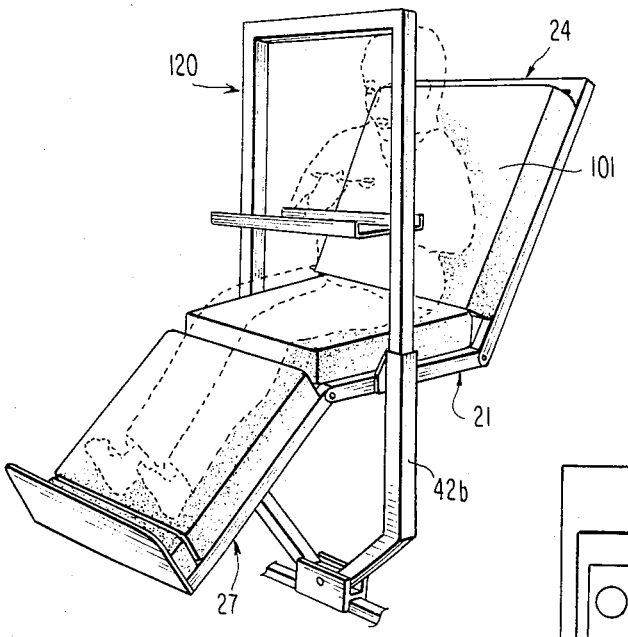
FIG. 7 is a somewhat schematic perspective view illustrating the installation of an eating table or working table in the hospital bed in accordance with the present invention.

FIG. 7 illustrates the hospital bed in accordance with the present invention when converted into an eating or working table for the patient by the use of an adapter frame structure generally designated by reference numeral 120 which is installed, for example, into the upright hollow frame members 42*a* and 42*b* or in any other suitable manner.

Figure 8:
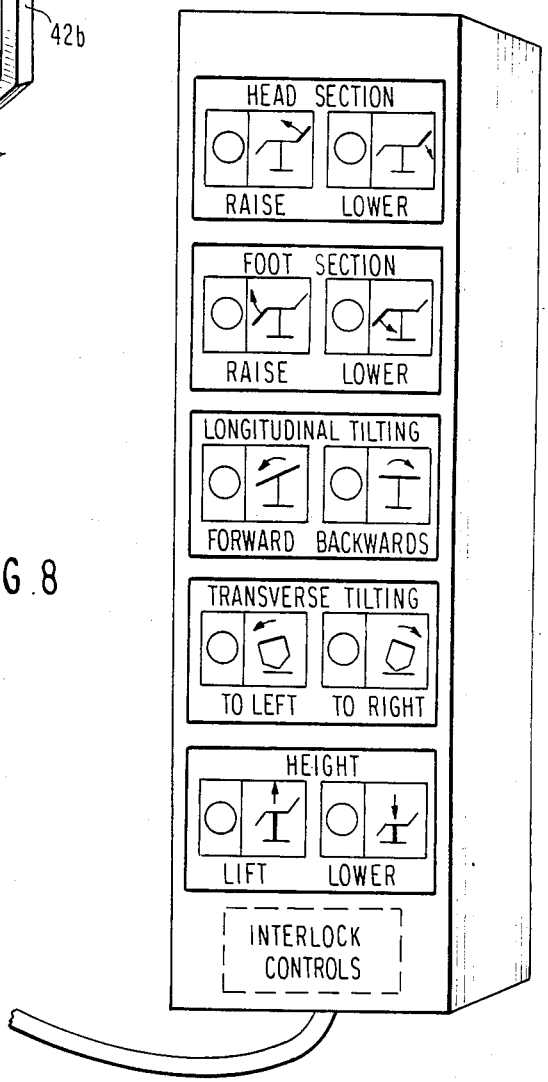
FIG. 8 is a plan view on the control panel for a hospital bed of this invention.

FIG. 8 illustrates a control panel with the various control elements to provide selective control of the actuating units 50, 60, 70, 80 and 90 by the patient.

Further, the headboard may be detachably mounted on the bed frame to permit interchange with a modified headboard that includes retention means, for example, in the form of boots, straps or the like for holding the feet of the patient in place. This will permit a patient to be suspended in an inverted position once he is turned around on the bed 180° from the position when stepping onto the bed. After the feet are strapped to the substitute headboard, the patient can then be positioned heads-down so that the patient will hang suspended from his feet to provide therapeutic exercises.

Thus, the present invention provides a number of features which cooperate to produce, by extraordinarily simple means, a hospital bed offering great versatility in use for differing conditions of patients.

While I have shown and described only one embodiment in accordance with the present invention, it is understood that the same is not limited thereto but is susceptible of numerous changes and modifications as known to those skilled in the art, and I therefore do not wish to be limited to the details shown and described herein, but intend to cover all such changes and modifications as are encompassed by the scope of the appended claims.

I claim:

1. A hospital bed, comprising a chassis means including rigidly interconnected longitudinal and cross bearer members, bed frame means including a center bed frame section, a head bed frame section pivotally connected about a first transverse axis to the center bed frame section near one end therof and a foot bed frame section pivotally connected about a second transverse axis to the center bed frame section near the other end thereof, a first intermediate frame means pivotally supporting the center bed frame section intermediate its ends about a single third transverse axis to provide pivotal movement of the bed frame means about said third transverse axis in either direction of rotation, a second intermediate frame means pivotally supporting said first intermediate frame means about a longitudinal axis to enable tilting of said first intermediate frame means together with said bed frame means about said longitudinal axis in either direction of rotation, means so connecting said second intermediate frame means with said chassis means that said bed frame means can be pivoted into an at least nearly vertical position with the foot bed frame section at the bottom without interference by the corresponding cross bearer member of the chassis means so as to enable a patient to get on and off the hospital bed in an ambulatory manner, and first, second, third, fourth, and fifth actuating means for respectively causing (a) pivotal movement of the head bed frame section relative to the bed center frame section about the first transverse axis, (b) pivotal movement of the foot bed frame section relative to the bed center frame section about the second transverse axis, (c) pivotal movement of the bed frame means relative to the first intermediate frame means and therewith relative to the second intermediate frame means and the chassis means about the third transverse axis, (d) pivotal movement of the first intermediate frame means and therewith of the bed frame means relative to the second intermediate frame means and therewith relative to the chassis means about the longitudinal axis, and (e) adjustment in height of the second intermediate frame means and therewith of the first intermediate frame means and of the bed frame means relative to the chassis means.

2. A hospital bed according to claim 1, wherein said second intermediate frame means is formed by a parallelogram-linkage system including four substantially parallel frame members, two frame members each being pivotally connected near the lower end thereof to a respective longitudinal bearer of the chassis means so as to pivot about substantially transverse axes and the four parallel frame members being pivotally interconnected near the upper ends thereof by longitudinal and cross-connecting frame members.

3. A hospital bed according to claim 2, wherein the parallelogram-linkage system is pivotally connected to the longitudinal bearer members of the chassis means nearer the end thereof in the direction of the foot bed frame section.

4. A hospital bed according to claim 3, wherein said four frame members of the parallelogram-linkage system are nearly parallel to the longitudinal bearer means when the bed frame means is in its lowermost position, and pivot upwardly in a direction toward said last-mentioned end of the chassis means for raising the bed frame means.

5. A hospital bed according to claim 4, wherein said first intermediate frame means is of yoke-like configuration.

6. A hospital bed according to claim 4, wherein said third actuating means includes a gear operatively connected with said center bed frame section to rotate in unison therewith about said third axis and a linear actuator means including an extensible member provided with a rack operable to engage with the gear.

7. A hospital bed according to claim 6, wherein the linear actuator means includes an electric motor operatively connected with a linear member forming said extensible member.

8. A hospital bed according to claim 4, wherein each of said five actuating means includes an extensible linear member and an electric driving motor operatively connected with said linear member.

9. A hospital bed according to claim 8, wherein a respective electric motor is operatively connected with a corresponding linear member to provide a self-locking action.

10. A hospital bed according to claim 8, further comprising control means including separate selectively operable means for separately selectively energizing each electric motor for rotation in either direction.

11. A hospital bed according to claim 10, wherein said control means includes interlocking means for preventing energization of the electric motor of said fourth actuating means unless at least said center bed frame section is in its horizontal position.

12. A hospital bed according to claim 10, wherein said interlocking means are operable to prevent energization of the electric motor of said fourth actuating means unless all bed frame sections are in the horizontal position.

13. A hospital bed according to claim 10, wherein said control means includes means for selectively disabling one or more of said selectively operable means.

14. A hospital bed according to claim 10, further comprising a number of separate mattress parts for the bed frame sections, at least one of said mattress parts for the bed center frame section being replaceable by a corresponding part forming a toilet seat, and means for temporarily holding the patient in the position of at least near maximum height of the hospital bed while the hospital bed is being lowered by said fifth actuating means to permit substitution of the toilet seat for said one mattress part before said hospital bed is raised again into its pre-existing position.

15. A hospital bed according to claim 14, further comprising a basin adapted to be removably installed underneath the toilet seat.

16. A hospital bed according to claim 1, further comprising a number of separate mattress parts for the bed frame sections, at least one of said mattress parts for the bed center frame section being replaceable by a corresponding part forming a toilet seat, and means for temporarily holding the patient in the position of at least near maximum height of the hospital bed while the hospital bed is being lowered by said fifth actuating means to permit substitution of the toilet seat for said one mattress part before said hospital bed is raised again into its pre-existing position.

17. A hospital bed according to claim 16, further comprising a basin adapted to be removably installed underneath the toilet seat.

* * * * *